US008127421B2

(12) United States Patent
Sutton

(10) Patent No.: US 8,127,421 B2
(45) Date of Patent: Mar. 6, 2012

(54) THREE-DIMENSIONAL BRANCHING STRUCTURES AND METHODS FOR MAKING AND USING SAME

(76) Inventor: Sam Sutton, Sedona, AZ (US)

( * ) Notice: Subject to any disclaimer, the term of this patent is extended or adjusted under 35 U.S.C. 154(b) by 1505 days.

(21) Appl. No.: 11/600,893

(22) Filed: Nov. 14, 2006

(65) Prior Publication Data

US 2008/0113125 A1 May 15, 2008

(51) Int. Cl.
*B23P 25/00* (2006.01)

(52) U.S. Cl. ..... 29/458; 29/460; 29/469; 29/505; 428/15; 428/16; 428/17; 428/18; 428/19; 428/20; 428/21

(58) Field of Classification Search ..... 428/15–27, 428/3, 12, 542.2, 542.4, 542.6; 29/458, 460, 29/469, 505, 525.01, 525.02
See application file for complete search history.

(56) References Cited

U.S. PATENT DOCUMENTS

| | | | | |
|---|---|---|---|---|
| 1,829,687 | A | 10/1931 | Takiguchi | |
| 1,906,989 | A | 5/1933 | McMillan | |
| 2,503,359 | A | 4/1950 | Smith | |
| 2,508,925 | A | 5/1950 | Metz | |
| 2,893,149 | A | 7/1959 | Reece et al. | |
| 5,091,227 | A | 2/1992 | Wright et al. | |
| 5,284,536 | A | 2/1994 | Gruber | |
| 5,508,070 | A * | 4/1996 | DiLapo et al. | 428/24 |
| 5,609,928 | A * | 3/1997 | Yedlin et al. | 428/5 |
| 5,714,211 | A * | 2/1998 | Zinbarg et al. | 428/16 |
| 5,759,645 | A | 6/1998 | Li | |
| 5,962,088 | A | 10/1999 | Tanaka et al. | |
| 6,017,596 | A * | 1/2000 | Deraney | 428/27 |
| 6,033,753 | A | 3/2000 | Liao | |
| 6,037,021 | A * | 3/2000 | Koo | 428/10 |
| 6,093,459 | A * | 7/2000 | Puleo, Jr. | 428/20 |
| 6,265,035 | B1 * | 7/2001 | Sniderman | 428/11 |
| 6,329,028 | B1 | 12/2001 | Bucher | |

OTHER PUBLICATIONS

Forty-Two Photographs of Sculptural Trees—Collected from the Internet, Oct. 2006, 9 pages.

* cited by examiner

*Primary Examiner* — David Bryant
*Assistant Examiner* — Bayan Salone

(57) ABSTRACT

The specification and drawing disclose the steps and structure involved in making one of a wide variety of three-dimensional branching structures that can be individually formed into extremely complex spatial representations of natural or abstract shapes suitable for viewing from many perspectives. A branching structure in the form of a wall-mounted tree is comprehensively disclosed along with means for affixing leaves to the tree to further simulate the form of a tree and for the further (optional) purpose of physically memorializing persons or events. A second embodiment is also disclosed to suggest the wide range of variations possible through employment of the basic method steps and to illustrate a form of branching structure that can be viewed from any horizontal or vertical perspective.

19 Claims, 10 Drawing Sheets

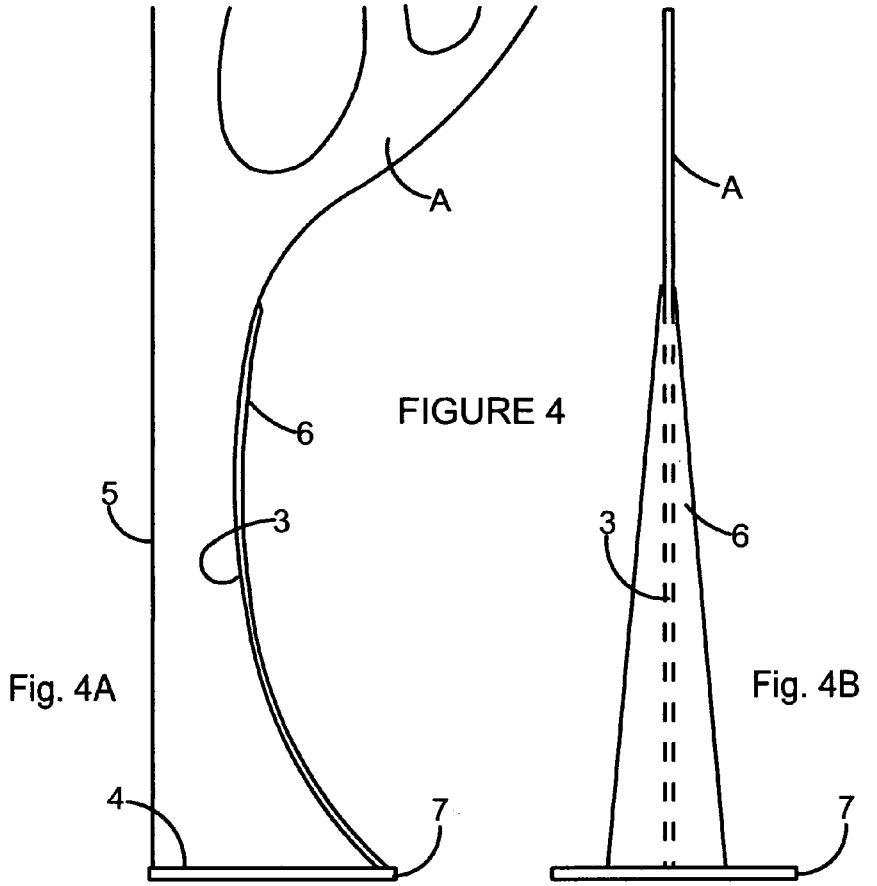
FIGURE 4
Fig. 4A
Fig. 4B
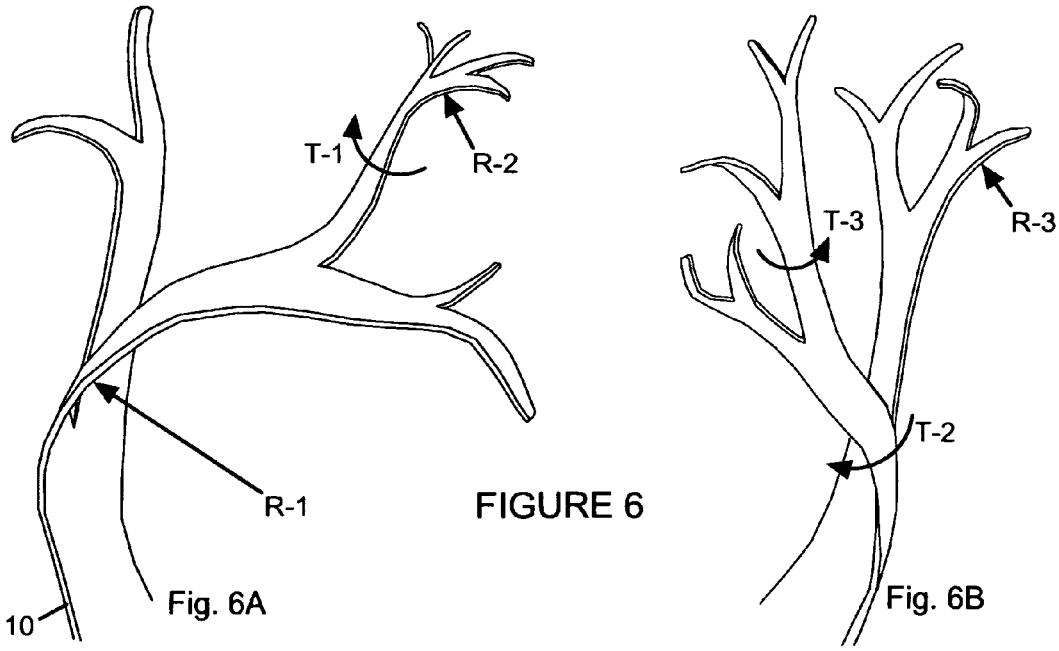
FIGURE 6
Fig. 6A
Fig. 6B

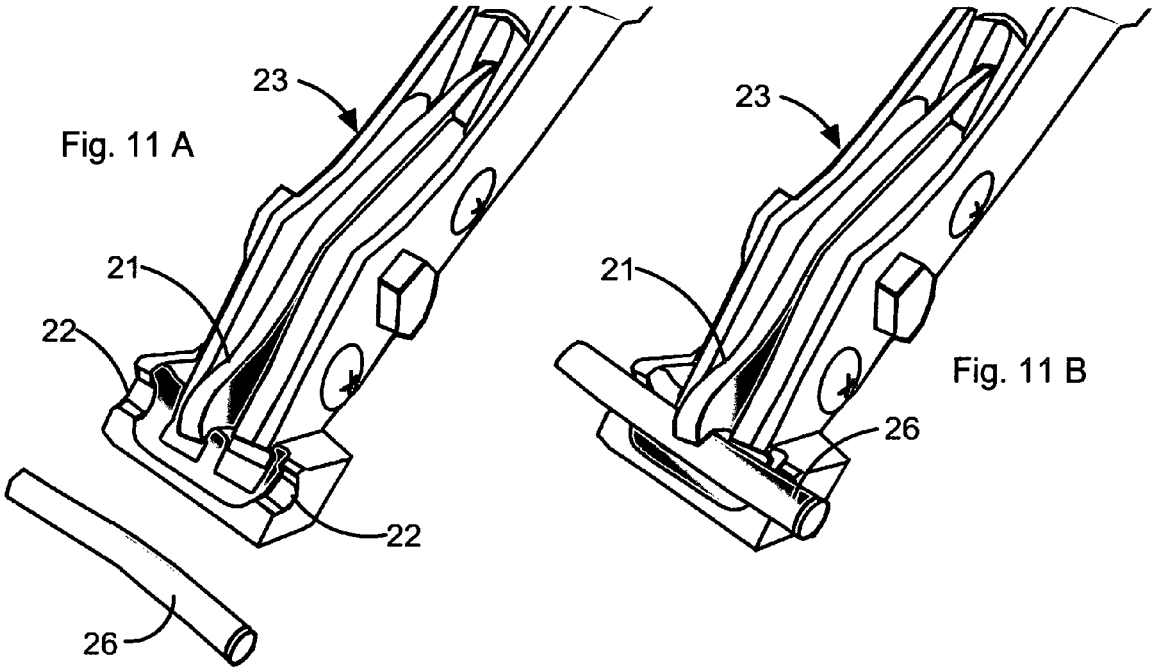
Fig. 11 A
Fig. 11 B
FIGURE 11
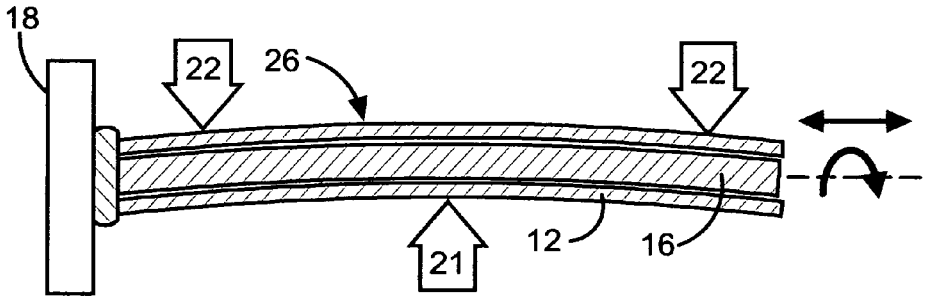
Fig. 11 C

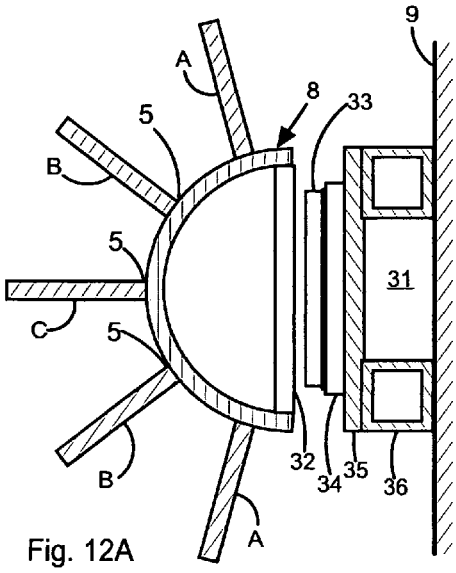
Fig. 12A
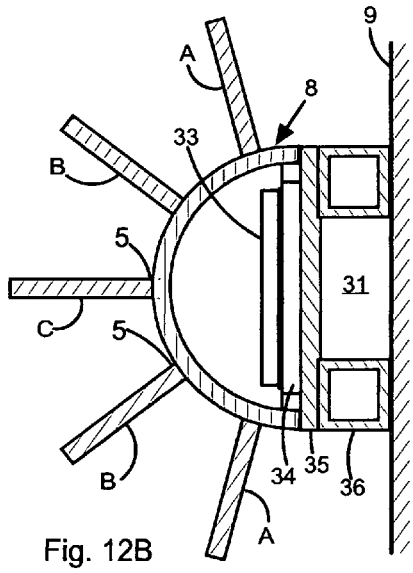
Fig. 12B
FIGURE 12
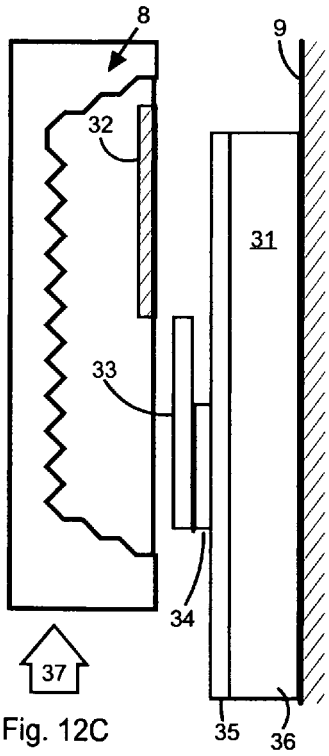
Fig. 12C
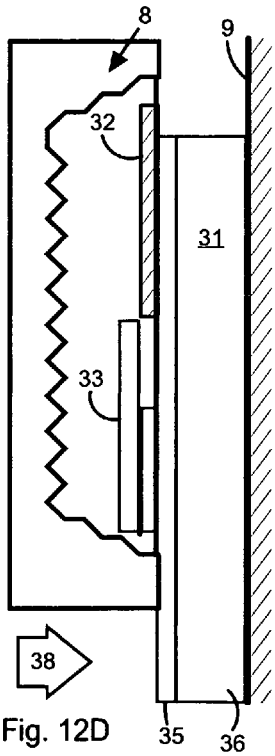
Fig. 12D
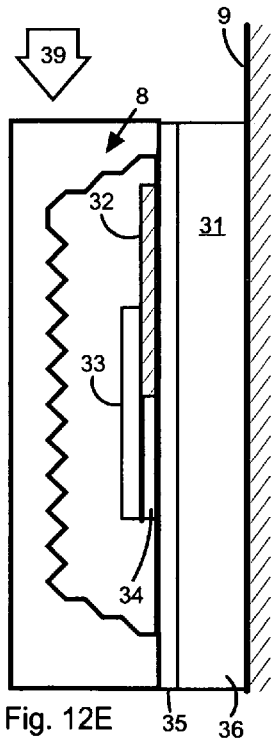
Fig. 12E

THREE-DIMENSIONAL BRANCHING STRUCTURES AND METHODS FOR MAKING AND USING SAME

BACKGROUND OF THE INVENTION

The invention relates to three-dimensional branching structures and methods for making and using such structures, which are often used to depict, represent or simulate naturally occurring, synthesized or mathematically defined branching patterns for artistic, educational, technical or expressive purposes. Some of the branching patterns are observed in trees, shrubs, grasses, bacterial colonies, arterial networks, antlers, corals, ferns, cacti, river systems, watersheds, respiratory networks, as well as fractal, electronic, logical and mathematical patterns and networks.

Over the years, the branching patterns observed in woody plants—especially trees—have been the frequent subject of efforts at three dimensional depiction. Indeed, there are currently over 400 United States patents classified or cross referenced in Class 428/18 which includes simulated trees and any other "article wherein the product simulated or treated is at least part of the woody portion of a woody perennial plant, which plant is generally distinguished by a substantially sized single or main trunk with attached branches and foliage." Sculptors have applied their creativity in producing thousands of different forms of trees in both bas-relief and fully three-dimensional configurations.

Trees have been simulated by means of simple cutouts (as shown, for example in U.S. Pat. No. 2,508,925); by connecting artificial branches so they radiate outward from various points on a central "trunk" (as shown, for example in U.S. Pat. No. 2,893,149); by connecting large leaves to one or more portions of a central "trunk" (as shown, for example in U.S. Pat. Nos. 5,091,227, 5,759,645 and 6,033,753); by connecting flat planes to vertical "trunks" to represent arrays of leaves (as shown, for example in U.S. Pat. Nos. 2,503,359, 5,284,536 and 6,329,028); and, by cutting out and folding uniform pairs of bough-shaped or spike-shaped segments and connecting the pairs along a common fold (as shown, for example in U.S. Pat. No. 1,906,989). One of the most realistically depicted branching patterns are those associated miniature plants that have been subjected to extensive, long-term human pruning and manipulation techniques known as bonsai. Bonsai trees, already largely human-directed in their form, have been very successfully depicted through the use of wire forming techniques (such as those described in U.S. Pat. Nos. 1,829,687 and 5,962,088).

Two factors combine to make it both difficult and expensive to create realistic and aesthetic representations of natural branching patterns, such as those found in trees. These factors can be characterized in terms of the spatial volume and inherent complexity of these naturally occurring structures. The meaningful translation of this complexity into proportionate space-filling simulations has been the goal of artists and sculptors for centuries. While some degree of success has been achieved in the case of small three-dimensional structures, like bonsai simulations, the techniques used do not effectively scale up to larger representations. Artificial Christmas trees, which typically measure up to about 8 feet in height, have been developed to a point where many commercially available, machine-made, products provide a fair approximation of the texture, density and uniform conical shape seen in farm grown trees. However, the techniques used to produce these trees are limited to basic conifer varieties that are generally characterized by a single central trunk from which straight side branches extend to fill the surrounding space and define the shape of the tree. The Douglas Fir provides a prototype variety for the simulation techniques used in producing many artificial Christmas trees. True branching structures are far more complex in their growth patterns and overall forms, with multiple levels of divergent branches and sub-branches growing at many different angles and through many divergent plains. These complex branching patterns, which are far more engaging to the viewer, can be seen in natural varieties such as elm, dogwood, maple, eucalyptus, palo verde, mesquite, walnut, juniper and even baobab trees. The branching patterns of shrubs, corals and many sea creatures are similarly complex and resistant to meaningful three-dimensional representations.

For many years organizations have used two-dimensional versions of tree-like branching structures in conjunction with fund-raising programs for hospitals, schools and churches. A flat depiction of a short tree segment is cast in plastic or metal or cut from fiberboard, wood or metal and mounted on a wall in the organization's office or facility. Minimum donations to the organization are memorialized by gluing or otherwise attaching a small leaf-like plaque bearing the name of the donor on the wall next to one of the branches. The two-dimensional outlines used in these programs do not meaningfully depict the complexity of even the simplest branching structure found in most trees, nor do the adjacent leaves pretend to be more than symbolic. These "donor recognition trees" have been quite successfully used, but the total funding raised is limited by the number of leaves that can be affixed on or adjacent to the flat tree segments. Typically one of these flat trees can support between 350 and 450 leaves and will require between 7 and 8 feet of wall space. By contrast, a three-dimensional tree structure made in accord with the present invention can accommodate some 1230 leaves, requires less wall space and continually engages observers with the sense of volume and complexity that characterize the natural beauty of trees.

It is the primary objective of the present invention to provide structures and methods for making structures capable of realistically depicting the space-filling complexity of naturally occurring and synthesized branching structures and to achieve this objective at a lower overall cost as compared to other methods when used to produce an equal level of branching volume and complexity.

It is a further objective to provide methods for use in making articles that meaningfully and aesthetically depict a wide range of naturally occurring and synthesized branching structures and do so in ways that both accommodate and enable individual forms of artistic, educational and technical expression in the final article.

It is another objective to provide a specific embodiment of the invention that finds particular utility in highly leveraged organizational fund raising programs constructed on the universal aesthetic appeal derived from the complex branching patterns of a tree.

SUMMARY OF THE INVENTION

The invention encompasses three-dimensional branching structures and related methods which can be most efficiently summarized in terms of the steps by which these structures are made, including:

a. forming a plurality of branching sections, each of said sections being generally flat in relation to an initial plane and having a reference edge from which multiple branching segments extend, said segments being suitable for at least partial deformation through bending and twisting;

b. joining said branching sections in fixed spatial relation to one another by connecting said sections to a common mounting structure;

c. deforming selected portions of said branching segments by transposing them from their initial positions in relation to said initial plane to final positions that are at least partially transverse to said initial plane; and, d. optionally securing attachments to distributed connection points on said branching segments.

DESCRIPTION OF THE DRAWING

FIG. 4. This figure includes a partial side view (FIG. 4A) and a partial front view (FIG. 4B) of one of the tree sections shown in FIG. 3, further including a tapered trunk segment fitted to the lower portion of the tree section.

FIG. 6. This figure includes two detail views (FIG. 6A and FIG. 6B) of representative branching segments of the tree sections shown in FIG. 3 after these segments have been selectively bent and twisted out of and transverse to the initial plane of the tree section.

FIG. 11. This figure includes two detailed views (FIGS. 11A and 11B) of a bending tool for securing stem pairs and an enlarged view (FIG. 11C) of a stem pair assembly showing the two elements secured against lateral displacement and rotation after bending.

FIG. 12. This figure includes a series of five views (FIGS. 12A through 12E) depicting the structures and steps involved in detachably connecting a finished tree (as shown in FIGS. 1 and 2) to a vertical wall at the final installation site.

DESCRIPTION OF THE INVENTION

Figure 1:
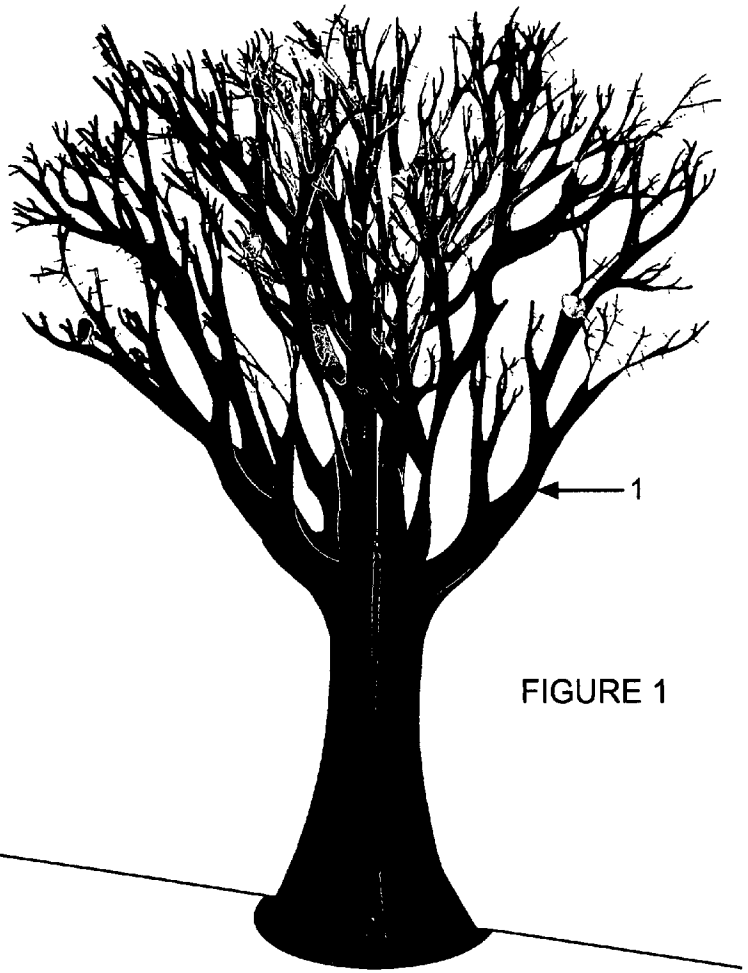
FIG. 1. This is a perspective view of an actual tree structure produced as the first embodiment the invention and measuring approximately 8 feet tall, 7 feet wide and 4 feet deep.

A detailed description of the invention will be presented with primary reference to a branching structure physically embodied in the form of a sculptural tree that was produced for use in a fund-raising program initiated by the Gloria Dei Lutheran Church in Paradise Valley, Ariz. The three-dimensional tree structure 1 as shown in FIG. 1 and further described in relation to FIGS. 2 through 6 was constructed in accord with the present invention and dedicated in the church foyer on Nov. 5, 2006. When donors make contributions to the church in recognition of a person or event, the donation is acknowledged by permanently affixing to the tree a leaf 11 as shown and further described in relation to FIGS. 7 through 11. The leaf may optionally bear an inscription, such as the name of the donor, event or honoree (collectively "event").

As constructed, the tree 1 of FIG. 1 measures approximately 8 feet tall, 6 feet wide and 4 feet deep. It has the capacity to receive approximately 1230 separate leaves that would serve to acknowledge approximately $600,000 in donations at $500 per leaf. The modular and scaleable nature of the structure allows higher densities to be achieved by increasing the size of the structure or by expanding it from a 180 degree wall-mounted configuration to a 360 degree free standing configuration, as described in relation to another branching structure described in relation to FIGS. 13 and 14.

Figure 2:
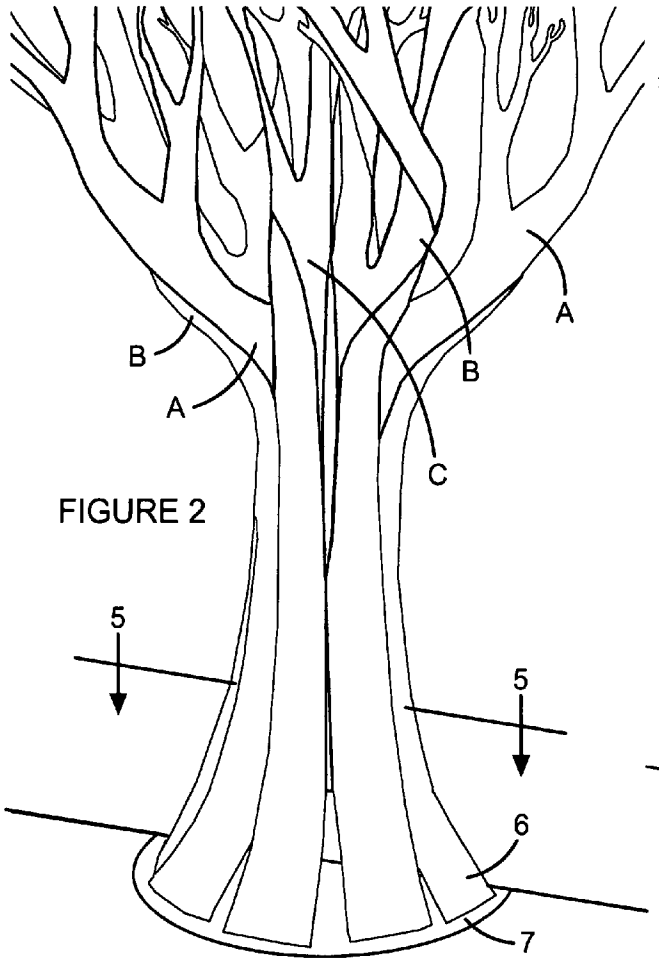
FIG. 2. This is a detail line drawing showing the trunk and lower branching portions of the tree structure shown in FIG. 1.
Figure 3:
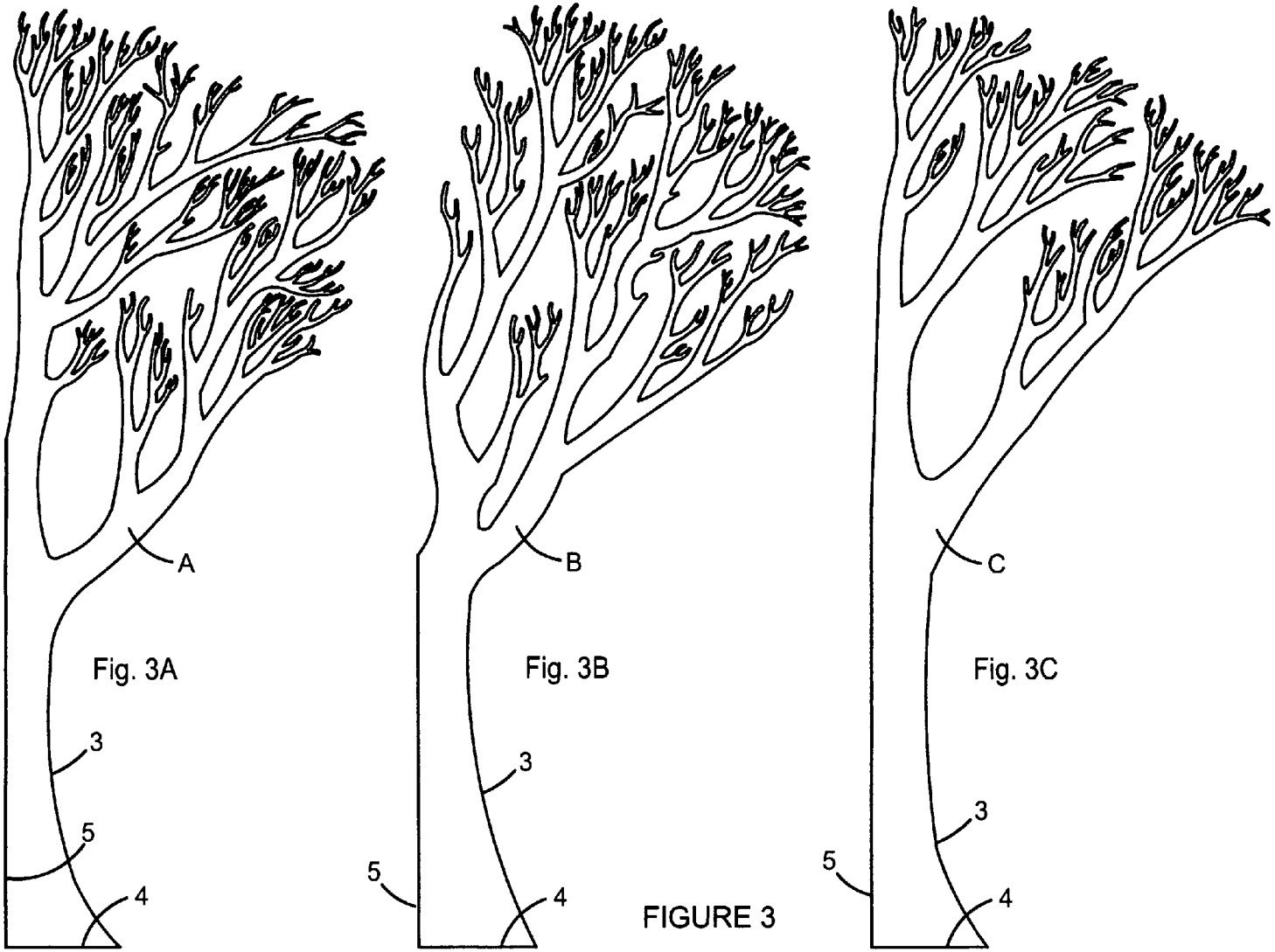
FIG. 3. This figure includes three computer-generated drawings (FIG. 3A, FIG. 3B and FIG. 3C) that correspond to the tool paths used to cut the flat tree sections used in fabrication of the tree structure shown in FIG. 1.

The branching tree structure 1 of FIG. 1 consists of an upper branching portion and a lower trunk portion. The lower trunk portion is shown in greater detail in FIG. 2. The tree 1 is made up of five connected sections of the type shown in FIG. 3. The tree section shown in FIG. 3A is generally designated by the letter reference A while the tree sections shown in FIGS. 3B and 3C are respectively designated by the reference letters B and C. As generally shown in FIGS. 1 and 2, the tree structure 1 includes five radiating tree sections shown in FIG. 3: two of the sections are type A, two are type B and one is type C. These tree sections are connected along their reference edges 5 to a central mount 8 as shown in the section view of FIG. 5 and the detailed views of FIGS. 12A and 12B.

The tree section drawings in FIG. 3 are reproductions of the tool path drawings used in cutting these sections from flat sheets of steel. These tree sections A, B and C each lie in an initial plane defined by the 4 foot by 8 foot sheets of 10 gauge (nominally 0.120" thick) steel from which they were cut using a computer controlled plasma torch. While the tree structure 1 was fabricated from branching sections cut from sheet material, similar branching sections could be formed by metal or other casting techniques that would produce functionally equivalent sections having varying thicknesses and surface textures. Likewise, while the tree structure 1 was fabricated from steel, other materials suitable for subsequent deformation by bending and twisting could be used; including, by way of example, brass, bronze, aluminum and heat formable plastic materials. Materials having positional memory or spring are not preferred and may require heating to assure fixed transformation from bending and twisting.

The tree 1 incorporates five tree sections of the types shown in FIG. 3, but could have included a greater or lesser number of these sections. The tree sections themselves could have been designed to use an almost unlimited variety of naturally inspired or synthesized branching patterns. The tree structure 1 shown in FIG. 1 was designed to mount against a flat wall (180 degree version); however, the same basic design with fewer tree sections could be modified for mounting in a corner (90 degree version) or, with two of the tree structures 1 joined together, as a single, free-standing structure (360 degree version). An example of a 360 degree version is described in relation to FIGS. 13 and 14.

As seen in FIG. 3, the lower portions of the tree sections A, B and C each include a curved outer edge 3, a bottom edge 4 and a reference edge 5. The two views in FIG. 4 show the lower portion of one representative tree segment, in this case, the lower portion of tree segment A. FIG. 4A shows a side view and FIG. 4B shows an edge view of this representative tree segment. A tapered trunk segment 6, cut (or otherwise formed) from the same material as the tree sections themselves, is positioned perpendicular to and centered on the outer edge 3 of tree segment A and is then shaped by clamping to conform to the outer edge 3 and then secured in position by welding or other suitable method. When trunk segments 6 are welded to the outer edges 3 of each of the tree segment A, B and C, they function to substantially stiffen the tree segments against lateral movement and deformation. This stiffening effect is further enhanced when the bottom edge 4 of each trunk segment is welded to the semi-circular base 7. As further described in conjunction with FIGS. 5 and 12, the reference edge 5 of each of the tree sections, is secured to a central mount 8 which holds the tree sections in fixed spatial relation to one another while providing further stiffening to the lower portion of the tree structure 1. As seen in FIGS. 1 and 2, the trunk segments 6, when viewed together as part of the finished tree structure 1, produce a more realistic visual impression of an actual tree trunk while also enhancing overall structural integrity and rigidity.

Figure 5:
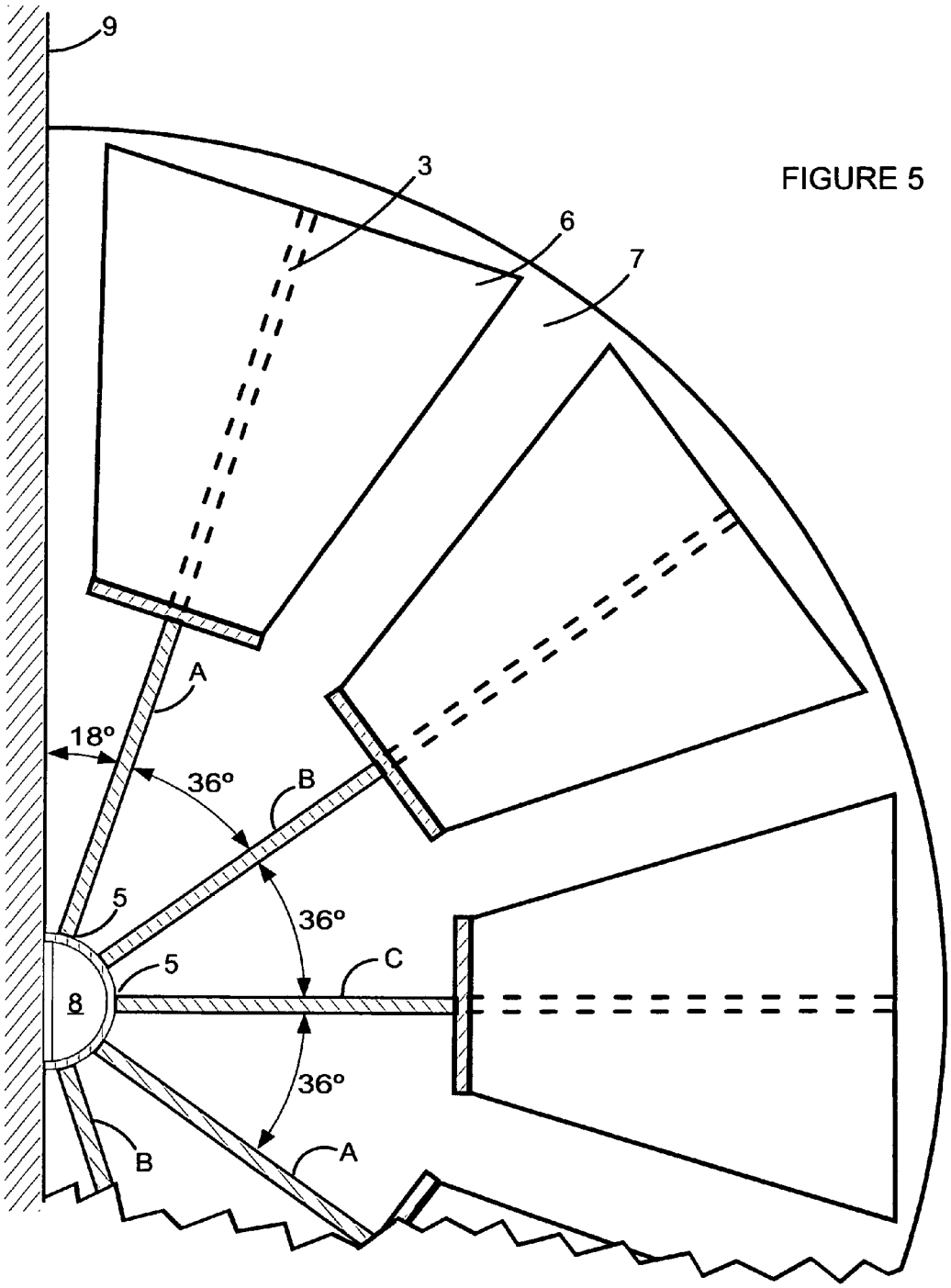
FIG. 5. This is a partial section view taken through the plane designated 5-5 in FIG. 2.

FIG. 5 is a partial section of the lower part of tree structure 1 viewed through the plane designated 5-5 in FIG. 2. A portion of each of the five tree sections A, B and C are shown connected to and radiating from the central mount 8. Central mount 8 is secured to the vertical wall 9 by means that will be further described in relation to FIG. 12. The reference edge 5 on each of the tree sections lies in the initial plane of the tree section and is affixed to the mount 8 by welding.

FIG. 5 shows the outer edges 3 of the tree sections (broken line) in relation to the corresponding trunk segments 6 and the semi-circular base 7. As indicated in FIG. 5, the tree sections are angularly spaced at approximately 36 degrees with respect to one another and by half this angle in relation to the wall 9. This angular spacing is not critical and is dictated primarily by the number of branching segments that are included in any particular design. The angular spacing shown in FIG. 5 (36 degrees) accommodates the connection of two tree structures 1 along their common mount 8 to form a single free standing tree structure that can be viewed from any angle around its central axis. An example of a 360-degree embodiment (having a different branching pattern) is described in relation to FIGS. 13 and 14.

FIG. 6 includes two representative views of the distal portions of the tree sections shown in FIG. 3 after individual branches and groups of branches have formed by bending and/or twisting to final positions out of the original planes defined by the corresponding tree sections shown in FIG. 3. FIG. 6A illustrates how an initial bend on radius R-1 brings the outer portion of the affected branch segment out of the original plane defined in part by the edge 10 that is initially coplanar with reference edge 5 and the remainder of the tree section as depicted in FIG. 3. A surprisingly natural look can be achieved by continuing to form this representative branch by means of twist T-1 and by further bending on radius R-2. A similarly natural effect can be seen in FIG. 6B where the branch segment has been formed through the introduction, for example, of twist T-2, twist T-3 and a bend on radius R-3. Obviously, the tree segments shown in FIG. 6 have been subject to additional bending and twisting deformations beyond those specifically referenced.

When the flat tree sections A, B and C are initially secured to mount 8, their respective branching patterns extend outward from their reference edges 5 in planes that diverge with approximately 36 degrees of separation. The bending and twisting process illustrated in FIG. 6 transposes the tree sections of FIG. 3 from essentially flat, two-dimensional, branching structures into more realistic three-dimensional, space-filling structures as shown by the representative embodiment of FIGS. 1 and 2. The branch segments are preferably formed so as to occupy much of the space between the initial planes of the tree sections.

Forming the branches to positions out of each tree section's original plane can produce a wide variety of effects and allows for significant visual and spatial expression in the production of the final branching structure. The bending and twisting of branch segments in the production of the tree structure shown in FIG. 1 was accomplished without heating the steel, aided only by simple sets of hand tools such as adjustable wrenches and hand-held benders. In cases where the width or thickness of a branch segment is too great for cold forming, heat may be widely applied to the area designated for deformation. Care should be taken to not to overheat a small, localized area as this may result in unnaturally sharp bends or twists. In cases where branch segments from adjacent sections crossed one another or came in very close proximity, a small stitch weld was used to inconspicuously secure the adjacent branch segments together. A dozen or so of these connections added a networked rigidity to the overall branching structure and limited relative movement between adjacent tree sections, which was especially advantageous during transportation and installation.

While the novel methods and structures of the present invention have substantial utility in producing or simulating a wide range of three-dimensional branching structures, further utility can be realized through the novel incorporation of attachments to augment the appearance and usefulness of such branching structures. These additional improvements will be described in relation to FIGS. 7 through 11.

Figure 7:
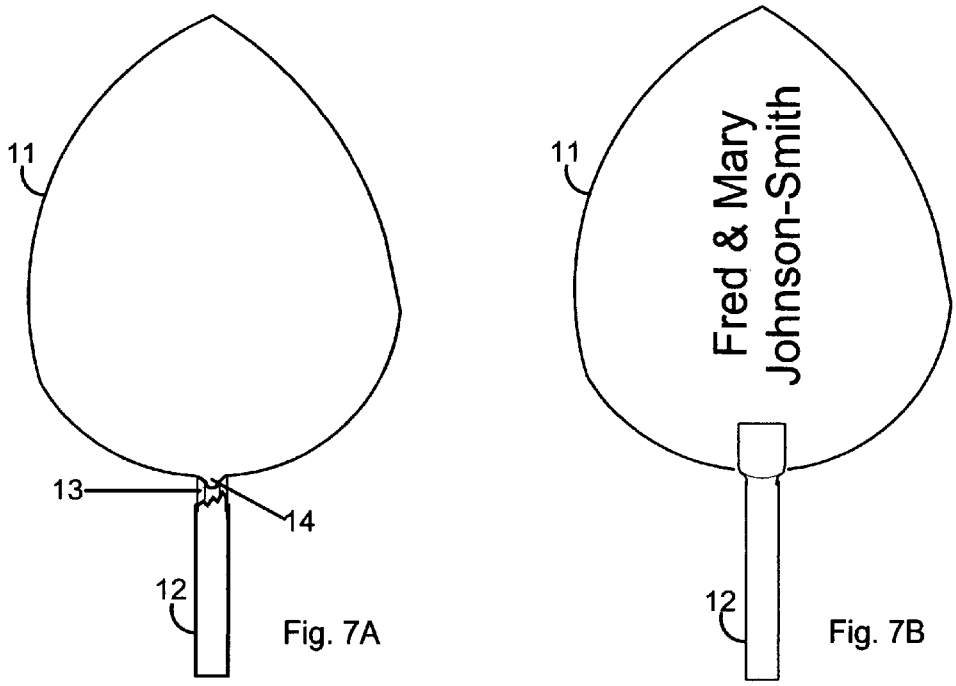
FIG. 7. This figure includes a partially cut away view (FIG. 7A) and an assembled view (FIG. 7B) of a representative leaf and leaf stem combination to be secured at distributed connection points on the branching sections of the tree shown in FIG. 1.

FIG. 7 illustrates a leaf 11 and leaf stem 12 which together form an attachment suitable for connection to the tree structure 1 shown in FIG. 1. Specifically, FIG. 7A shows a cut away view and FIG. 7B shows an assembled view of the leaf/stem combination. The leaves 11 as designed for use in conjunction with the tree 1 in FIG. 1 measured 2 inches wide and were cut from 0.022 inch thick copper sheet using a computer-controlled abrasive water jet system. The leaf stem 12 was formed from 3/16 inch (O.D.) medium hard copper tubing having a 0.032 inch wall thickness and cut to a length of approximately 1⅜ inches. An axially centered slit 13 was cut approximately ¼ inch into one end of each leaf stem 12 to receive the stem end of the leaf 11. The slit 13 was cut using a saw blade having a width of approximately 0.025 inches to produce a sliding fit with the leaf 11. The small stem tip 14 at the bottom of the leaf 11 serves to orient and register the leaf 11 in the bottom of slit 13 and in axial relation to stem 12. With the leaf 11 fully inserted into the slit 13, a two-ton manual arbor press was used to flatten the slit end 20 of the stem 12 and secure the leaf 11 within the slit 13, as shown in FIG. 10C and further described in relation to the other views in FIG. 10.

Figure 8:
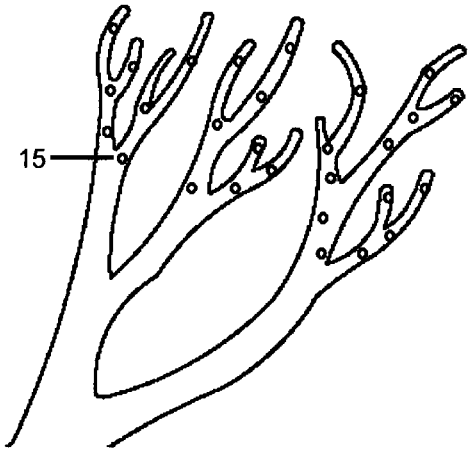
FIG. 8. This is a detailed view of a representative branching segment of a tree section shown in FIG. 3 which has been marked with dots to indicate some of the distributed connection points to which leaves such as the one shown in FIG. 7 may be permanently affixed.

FIG. 8 shows a representative segment from one of the branching sections shown in FIG. 3. The small circles 15 indicate a few of the many possible connection points that would be suitable locations for the attachment of a leaf 11 of the type shown in FIG. 7B. The branching tree structure of FIG. 1 was constructed with approximately 1230 of these connection points 15 distributed on both sides of the individual branches. While there are many different ways to secure the leaves 11 at the connection points 15, the preferred method employed in producing the structure of FIG. 1 is described below in relation to FIGS. 9, 10 and 11.

Figure 9:
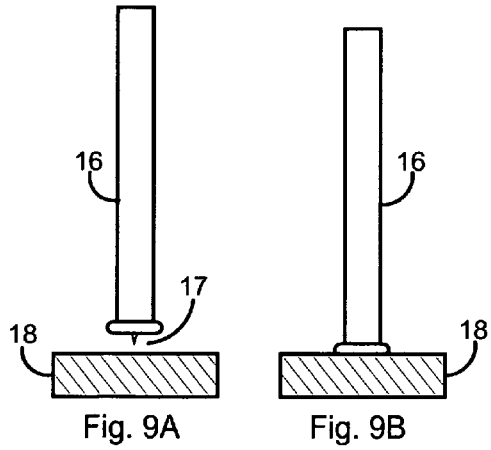
FIG. 9. This figure includes two detailed views of a representative branch stem before (FIG. 9A) and after (FIG. 9B) it has been stud welded to a branch segment at one of the distributed connection points indicated by the dots in FIG. 8.

FIG. 9 shows a branch stem 16 in the form of a commercially available weld stud having a small point 17 extending from below its shouldered base. The branch stem 16 chosen for this application was a standard stainless steel stud measuring one inch long and having a nominal diameter of 0.107 inch. Branch stems 16 are secured by the stud welding process at the various connection points 15 generally indicated in FIG. 8. Stud welding is a well-known process. The tip 17 of the weld stud (branch stem 16) is located over a connection point 15 while being held in a spring-loaded gun that exerts a continuous downward force on the branch stem 16 and maintains it in contact with the electrically grounded branch segment 18. While in this position, a capacitor is discharged and a controlled surge of current passes through the branch stem 16, melting the tip 17 and welding the bottom of the branch stem 16 to the surface of branch segment 18. Preferably, the stems 16 are secured to the branching sections (A, B, and C) while the sections are in their initial planar state, before any bending or twisting deformation of the branch segments has occurred.

Figures 10, 10A, 10B, 10C, 10D, 10E:
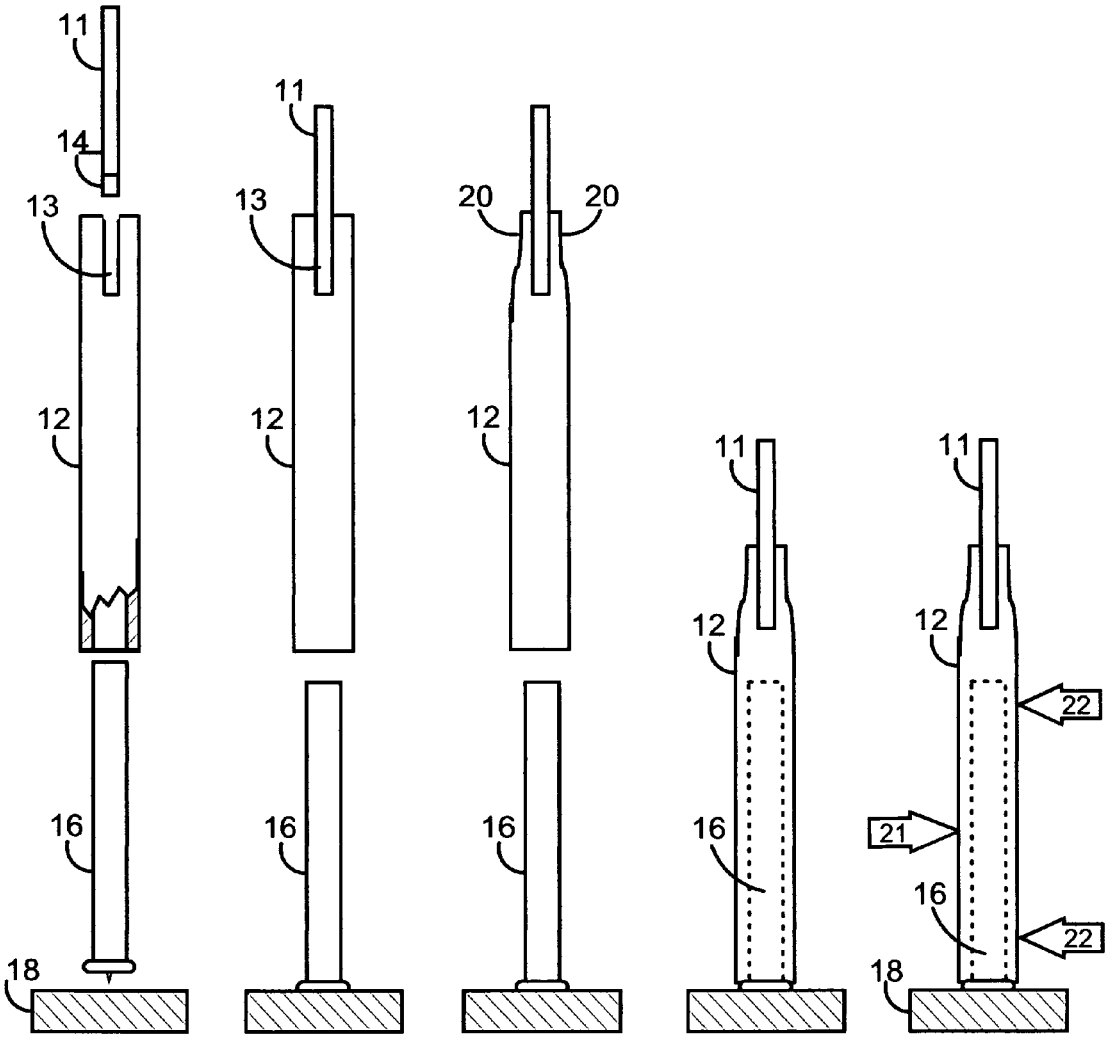
FIG. 10. This figure includes a series of five views (FIGS. 10A through 10E) depicting the steps by which a leaf of the type shown in FIG. 7 is assembled and secured to a branch stem (shown in FIG. 9) located at one of the distributed connection points (shown in FIG. 8).

FIG. 10 includes a series of five views that further illustrate the steps involved in assembling and securing leaf 11 by means of stems 12 and 16 to representative branch segment 18. FIG. 10A is an exploded view showing the edge of leaf 11 in aligned relation to the slotted end of leaf stem 12, branch stem 16 and branch segment 18. In FIG. 10B the bottom of leaf 11, including stem tip 14 is shown engaged in slot 13 at the end of leaf stem 12 while branch stem 16 is shown welded at one of the connection points on branch segment 18. FIG. 10C shows the slotted end portion 20 of branch stem 16 after it has been pressed and flattened over the lower portion of leaf 11 to form a tight connection.

FIG. 10D shows the leaf stem 12 fully engaged over branch stem 16 (broken line). At this point, the leaf 11 can be rotated to a final position. The final connection step is shown in FIG. 10E, where parallel bending forces 22 are opposed by the central bending force 21 to slightly deform the pair of coaxially engaged connection elements 12 and 16. With a limited difference between the inside diameter of leaf stem 12 and the outside diameter of branch stem 16, a very small bending deformation of these coaxial elements will fix them in relation to one another and prevent rotation or removal of the leaf 11 from branch segment 18.

FIG. 11 includes three views showing the structures and steps involved in securing the stems 12 and 16 to one another to form a stem pair 26. FIGS. 11A, 11B show a hand operated bending tool 23 adapted to exert the opposed bending forces 21 and 22 shown by the arrows in FIGS. 10E and 11C. These bending forces correspond to and include the same reference numerals as the opposing jaws 22 and arm 21 of bending tool 23 shown in FIGS. 11A and 11B. The bending tool 23 was made by adding opposing jaws 22 to a compound hand nibbler (catalogue number 35748) available from Draper Tools. When the bending tool 23 is closed over a stem pair 26, the arm 21 exerts the force indicated by arrow 21 and the two jaws 22 exert the opposing forces indicated by arrows 22 (FIGS. 10E and 11C).

FIG. 11C shows an enlarged view of a leaf stem 12 inserted over a branch stem 16 to form a stem pair 26. The opposing forces 21 and 22 bend the two coaxial stem parts and this deformation secures the two parts against axial displacement and rotation that would otherwise occur as indicated by the directional arrows on the right side of FIG. 11C. The leaves 11 (FIG. 7B) as fabricated for installation on tree 1 (FIG. 1) were made from a leaf stem 12 having an outside diameter of 3/16" and a wall thickness of 0.032" which resulted in an inside diameter of approximately 0.123". The weld stud used to form branch stems 16 had an outside diameter of 0.107" that was effectively increased to a diameter of about 0.114 when the entire tree structure 1 (including the branch stems 16) was powder coated. In this case, the inside diameter of leaf stem 12 was approximately 0.01" greater than the finished outside diameter of branch stem 16. This close sliding fit allowed the two stems 12 and 16 to be secured against rotation and separation by bending the combined stem pair 26 by any amount in excess of this small difference between their respective inside and outside dimensions.

The branch stems 16 are preferably welded at connection points 15 after the profiles of the tree sections (A, B and C) have been cut out (or otherwise formed) but before their various branching segments have been deformed out of the section's original plane by bending and twisting. This order greatly facilitates the process of stud welding the stems 16 at distributed points on both sides of the tree sections and perpendicular to the corresponding flat surfaces. After the stems 16 have been secured in place and the tree sections have been secured to the central mount 8, the various branching segments are formed by bending and twisting as shown in FIG. 6. As a result, the stems 16 are relocated into scores of different planes and realigned in hundreds of different directions. The resulting structural and visual complexity is multiplied as hundreds of leaves 11 are attached to the randomly oriented branch stems 16 extending from the distributed connection points 15. As more leaves are attached, the tree 1 is transformed from an image of deciduous winter to one of fully developed spring.

As indicated in FIG. 7B, the leaves 11 can bear inscriptions that physically memorialize people, events or contributions ("events"). The leaves 11 and stems 12 for use on tree 1 were made from copper sheet and tubing, as previously described. After the stem 12 was secured to the leaf 11, the combination was cleaned using an ammonia solution, rinsed with water and then repeatedly treated over several days with a spray patina solution produced by mixing the following compounds with 16 oz of water in the following amounts and order: (1) 4 tsp (20 mg) of ammonium chloride, (2) 2 tsp (10 mg) of copper sulfate, and (3) one-half tsp (2.5 mg) of copper acetate (while heating slightly, if required, to aid the solution process). This solution produced a natural medium green patina characterized by irregular green/blue-green variegation. After the patina was fully dried, the surface of the leaf/stem combination was sealed through the application of two clear coats of a matte lacquer spray. Indicia, such as the names shown in FIG. 7B were added through the use of standard burnishing techniques and equipment well known in the field of engraving. A mechanically controlled rotating burnishing tool was used to selectively remove the clear coat, the patina and the underlying film of oxidized copper, resulting in the exposure of the bright copper surface below and defining the desired indicia in terms of this exposed copper surface in visual contrast to the darker patina covering the remainder of the leaf. A second clear coat of matte lacquer spray was applied to prevent oxidation of the copper surface exposed as a result of the burnishing process.

The embodiment of the invention described in conjunction with FIGS. 1 through 6 was designed to be supported from below by a floor under base 7 (FIG. 2) and secured to wall 9 (FIG. 5) to prevent lateral movement. FIG. 12 includes six detailed views that illustrate the method and structures used to detachably secure the central mount 8 (and thus the tree 1) to wall 9. FIG. 12A is a top view looking down on the central most portion of tree 1 where the five branching sections A, B, C are joined by their reference edges 5 to the central mount 8. The five branching sections are separately identified as one of the A, B or C configurations shown in FIG. 3 and these sections are oriented in the same order shown in FIGS. 2 and 5 (counterclockwise order: A-B-C-A-B). In the first embodiment of the invention shown in FIGS. 1 and 2, the central mount 8 was fabricated from a 42-inch length of 2 inch OD steel tubing having a nominal wall thickness of 0.090 inch. This tube was cut in half along its central axis to form the semi-circular section of central mount 8 as shown in FIGS. 12A and 12B. Secured across the diameter and inside the central mount 8 are at least two (preferably three) cross bars 32 spaced apart along the length of the central mount 8. One of the cross bars 32 is shown in the top views of FIGS. 12A and 12B and in each of the partial section views of FIGS. 12C through 12E.

Secured to the wall 9 is a receiver 31 consisting of two vertical tubes 36 connected by a continuous bridge plate 35. Receiver 31 may be substantially the same length as the central mount 8 and is secured to the wall 9 by lag bolts or other means not shown. For each cross bar 32 included on central mount 8, there is a cleat consisting of a spacer 34 and an upward extending retainer 33 each secured to the bridge plate 35. As best shown in the side views of FIGS. 12C, 12D and 12E, the central mount 8 (to which the entire tree structure 1 is connected) is detachably connected to the wall-mounted receiver 31 by: (a) lifting the central mount 8 (and tree 1) upward as indicated by directional arrow 37 in FIG. 12C; (b) moving the central mount 8 into alignment above the receiver 31, as indicated by arrow 38 in the intermediate illustration of FIG. 12D; and (c) lowering the central mount 8 so that cross bar 32 slides behind retainer 33 securing the cross bar 32 and thus the entire tree 1 to the wall 9 as shown in the side view of FIG. 12E and the top view of FIG. 12B.

Figure 13:
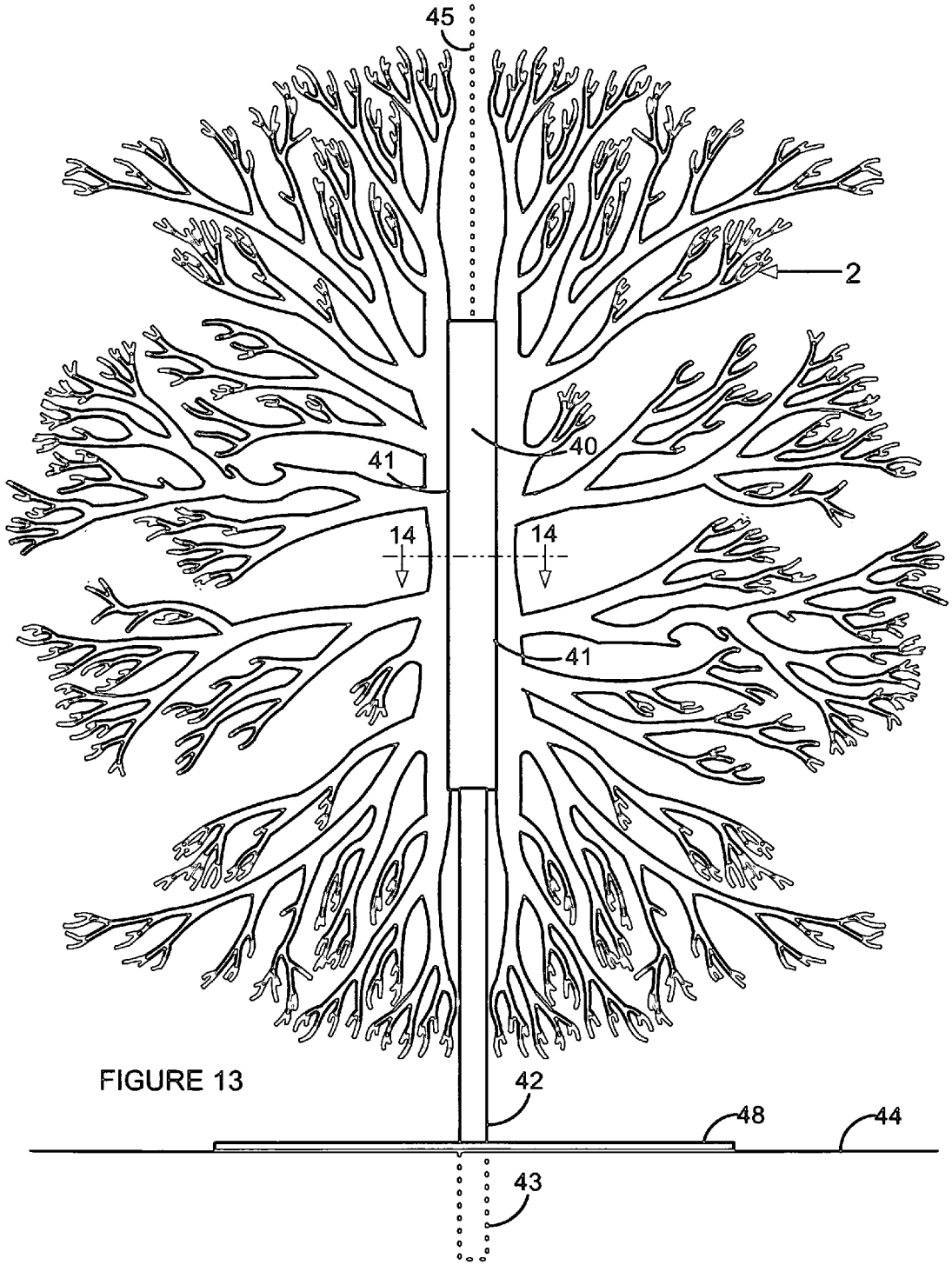
FIG. 13. This is a partial view showing, by way of example, how two of ten branching sections may be connected along a common edge to form a generally spherical branching structure, which can be ground mounted or suspended from above.
Figure 14:
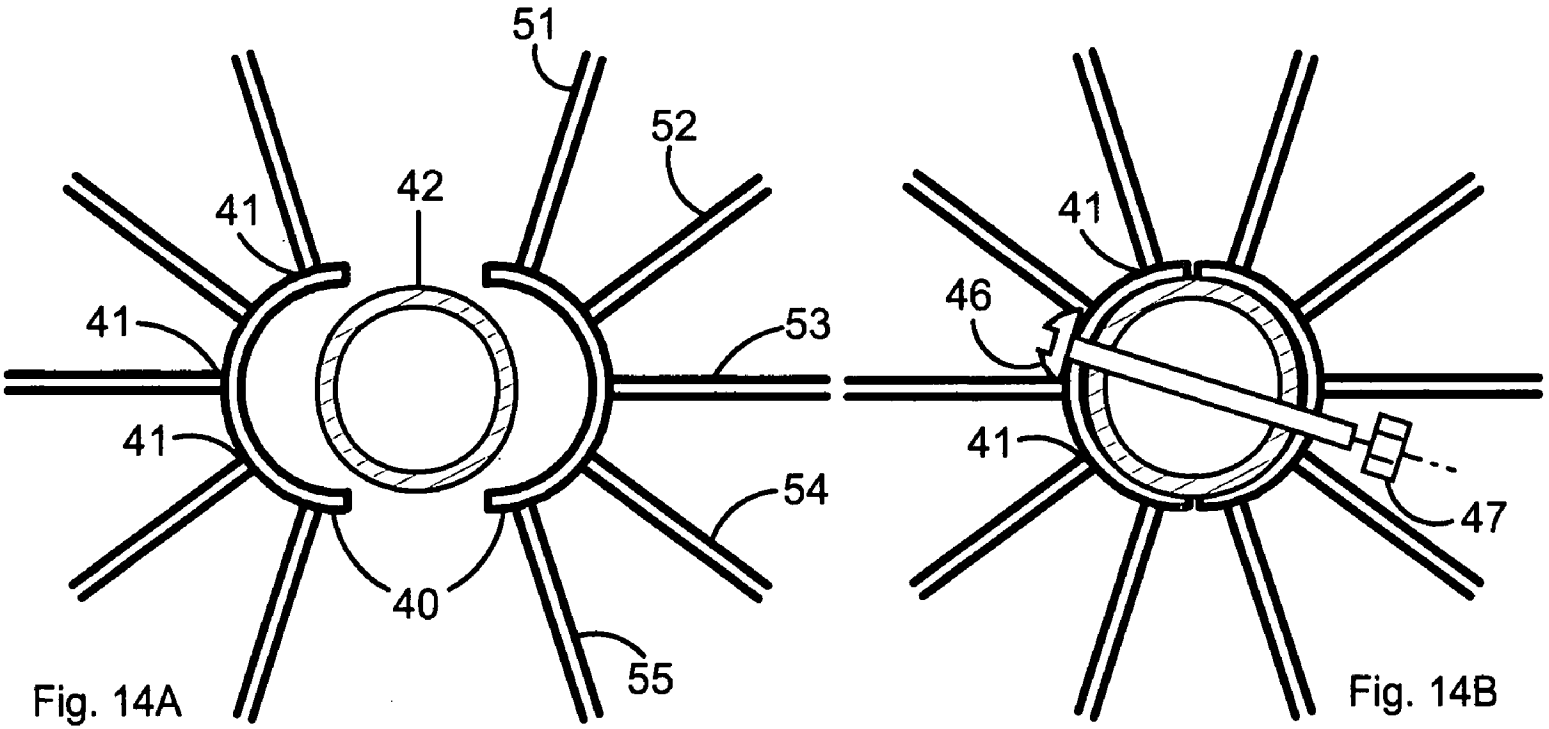
FIG. 14. This figure includes two partial section views (FIG. 14A and FIG. 14B) taken through the plane designated 14-14 in FIG. 13, showing the structures and steps involved in detachably connecting two sets of five branching sections of the type partially depicted in FIG. 13 to form a generally ellipsoidal branching structure.

FIGS. 13 and 14 suggest another of the almost unlimited number of branching structures that can be made using the basic techniques described in relation to the tree 1 of FIGS. 1 through 12. FIG. 13 shows two (left and right) generally co-planar sections of a different branching structure 2, one that does not include a trunk. The structure 2 can be supported from below by a foundation 44 or it can be suspended from above by a cable 45.

FIG. 14 consists of two partial section views taken at 14-14 in FIG. 13. The two halves of central mount 40 correspond structurally to the central mount 8 shown in FIGS. 12A and 12B. While the central mount 8 of FIG. 12 is designed to be secured to a vertical wall, the two halves of the central mount 40 in FIGS. 13 and 14 are designed to be secured to a concentric shaft 42 by means of bolts 46 and nuts 47 extending through the walls of mount 40 and shaft 42 as shown in the assembled view of FIG. 14B. The shaft 42 can extend downward and be secured to a suitable base plate 48 or within a foundation-mounted sleeve 43. Alternatively, the branching structure 2 can be suspended from above by a cable or chain 45.

The left and right sections of branching structure 2, as shown in FIG. 13, consist of branching segments cut from different parts of the three tree sections shown in FIG. 3 and assembled into two branching sections having their reference edges 41 affixed to central mount 40. The left and right branching sections of structure 2 represent two of ten such sections secured at their reference edges 41 and extending from the central mount 40 in equally spaced radial planes as illustrated in FIG. 14. By way of example, the five individual branching sections identified by reference numerals 51 through 55 would be secured along their reference edges 41 to one of the halves forming central mount 40 as shown in FIG. 14A. The branching sections incorporated into structure 2 can be variations of the two representative segments shown in FIG. 13 or any other branching configuration selected to provide a desired spatial representation. After the branching sections 51 through 55 have been connected to central mount 40, the individual branches and groups of branches on each section can be formed by selectively bending and twisting different segments and branches out of their original planes in the same manner previously shown and described in conjunction with FIG. 6. This will produce a complex branching structure having a natural form that can be viewed from any vertical or horizontal perspective while occupying an ellipsoidal volume that measures approximately 8 by 10 feet. The structure 2 can incorporate attachments (with or without inscriptions) by using the structures and following the steps described in conjunction with FIGS. 7 through 11.

The invention claimed is:

1. A method for making a three-dimensional branching structure generally characterized by a main axis, said method including the steps of:

a. forming a plurality of branching sections, each of said branching sections (i) being formed from a generally flat sheet of material characterized by an initial plane and (ii) including generally co-planar, branching segments extending from a predetermined reference edge, said branching segments including a plurality of branching divisions and sub-divisions extending to and terminating in individual branches;

b. joining said branching sections in a generally radial orientation with respect to one another by connecting said branching sections along portions of their respective reference edges, thereby characterizing the main axis of said branching structure; and, c. deforming selected portions of said branching segments by transposing the selected portions from their initial positions in relation to their corresponding initial plane to final positions that are at least partially transverse to said initial plane.

2. The method of claim 1, wherein the branching sections are joined by connecting portions of their respective reference edges to a common mounting structure that generally corresponds to the main axis of said branching structure.

3. The method of claim 2, wherein the branching sections are formed from sheets of metal.

4. The method of claim 3, including the additional step of securing first connector elements to receive attachments at predetermined connection points distributed on the surfaces of said branching segments.

5. The method of claim 4, including the additional step of fabricating a plurality of attachments, each attachment having a second connector element adapted to be secured to one of the first connector elements on the surfaces of said branching sections.

6. The method of claim 5, including the additional step of joining selected pairs of first and second connector elements to secure attachments at distributed connection points on said branching sections.

7. The method of claim 6, including the additional step of marking selected attachments with visible indicia.

8. The method of claim 5 wherein the branching sections depict planar outlines of a branching tree and the reference edges of said sections are connected to a vertically oriented mount.

9. The method of claim 6 wherein the branching sections depict planar outlines of a branching tree, the reference edges of said sections are connected to a vertically-oriented mount and the attachments depict leaves suitable for connection to the branching tree.

10. The method of claim 9, including the additional step of marking at least one of said attachments with visible indicia that memorialize an event.

11. The method of claim 4 wherein the deformation step is performed after first connector elements are secured to the branching sections.

12. The method of claim 1 including the additional step of coating the three-dimensional structure after the branching sections have been secured in spatial relation to one another.

13. The method of claim 4 including the additional step of coating the three-dimensional structure after first connection elements have been secured to the branching segments.

14. A method for making a three dimensional representation of a tree for use in memorializing events and fundraising, including the steps of:

(a) forming sheets of deformable material into a plurality of tree-shaped sections depicting outlines of a branching tree, each branching section including at least a portion of a trunk segment having a reference edge and multiple branching segments extending from the trunk segment;

(b) affixing studs at distributed connection points on said branching segments to receive leaf-shaped attachments;

(c) securing said tree-shaped sections together in a generally radial orientation with respect to the reference edges on their respective trunk segments;

(d) shaping selected portions of the branching segments by bending and twisting those portions out of the initial plane of the sheet used to form the corresponding branching section.

15. The method of claim 14 including the additional step of coating the three-dimensional structure.

16. The method of claim 14 including the further steps of: forming a plurality of leaf-shaped attachments; and, affixing to the leaf-shaped attachments a hollow tubular stem adapted to slide over and be secured to selected studs on said branching segments.

17. The method of claim 16 including the additional step of joining leaf-shaped attachments to branching segments at selected connection points.

18. A method for making a three dimensional representation of a tree for use in memorializing events and fundraising, including the steps of:

(a) forming from sheets of metal a plurality of generally planar branching sections, each section being representative of a portion of a tree including multiple branching segments suitable for receiving leaf attachments at distributed connection points;

(b) securing first connector elements at each of said connection points;

(c) connecting each of said branching sections in a three-dimensional spatial relationship to one another;

(d) shaping selected portions of the branching segments by bending those portions out of the original plane of the corresponding metal sheet;

(e) forming a plurality of leaf attachments to represent the events to be memorialized;

(f) providing each of said leaf attachments with a second connector element adapted to be joined to any one of said first connector elements; and, (g) joining selected pairs of first and second connector elements to secure leaf attachments at distributed connection points on said branching segments.

19. The method of claim 18 including the step of inscribing on each of said leaf attachments an indication associating the particular leaf attachment with the corresponding event that it memorializes.

* * * * *